US005743108A

United States Patent [19]

Cleland

[11] Patent Number: 5,743,108

[45] Date of Patent: Apr. 28, 1998

[54] GLYCOL CHILLER MACHINE

[76] Inventor: Robert K. Cleland, 11051 Via El Merado, Los Alamitos, Calif. 90720

[21] Appl. No.: 726,866

[22] Filed: Oct. 4, 1996

Related U.S. Application Data

[63] Continuation-in-part of Ser. No. 419,286, Apr. 10, 1995.

[51] Int. Cl.[6] ..... B67D 5/62; F25D 11/04

[52] U.S. Cl. ..... 62/393; 62/394; 62/439; 62/434

[58] Field of Search ..... 62/389, 392, 393, 62/394, 396, 430, 434, 436, 439

[56] References Cited

U.S. PATENT DOCUMENTS

| | | | |
|---|---|---|---|
| 476,832 | 6/1892 | Shipley | 62/434 |
| 1,722,578 | 7/1929 | Jancsy | 62/434 |
| 4,679,408 | 7/1987 | Nelson | 62/390 |
| 4,949,552 | 8/1990 | Adams | 62/196.4 |
| 5,247,811 | 9/1993 | Seya et al. | 62/434 |
| 5,579,650 | 12/1996 | Cleland | 62/392 |

*Primary Examiner*—William Doerrler

*Attorney, Agent, or Firm*—Georges A. Maxwell

[57] ABSTRACT

A glycol chiller comprising an elongate vertical sheet metal tank with front and rear walls, laterally spaced vertical end walls, vertically spaced top and bottom walls and a horizontal intermediate wall spaced between the top and bottom walls and defining a lower glycol chiller chamber and an upper glycol reservoir within the tank filler opening in the top wall, a flow through port in the intermediate wall conducting glycol from the reservoir into the chamber, a plurality of spaced apart partitions in the chiller chamber defining an elongate zig zag glycol flow passage with upstream and downstream ends within the chamber, glycol inlet and outlet fittings communicating with opposite ends of the flow passage and projecting from the tank to connect with glycol return and delivery lines extending from a related heat exchanging device; a motor driven pump downstream from the inlet fitting and operating to continuously recirculate glycol through the flow passage and the selected heat exchange device; an electric powered freon charged refrigeration machine including an elongate zig zag evaporator coil extending longitudinally and centrally through the passage; and, a thermal insulating jacket structure about he exterior of the tank.

6 Claims, 3 Drawing Sheets

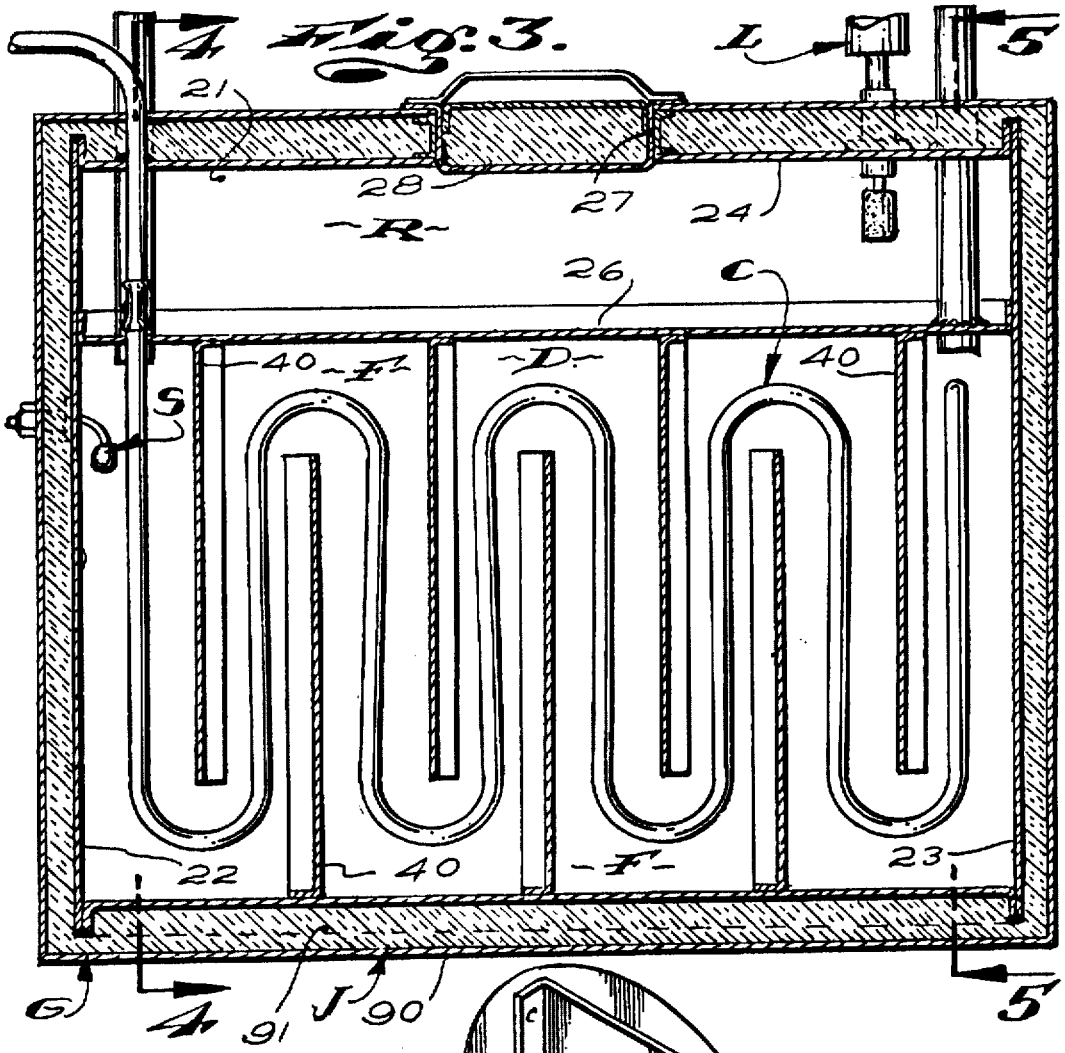
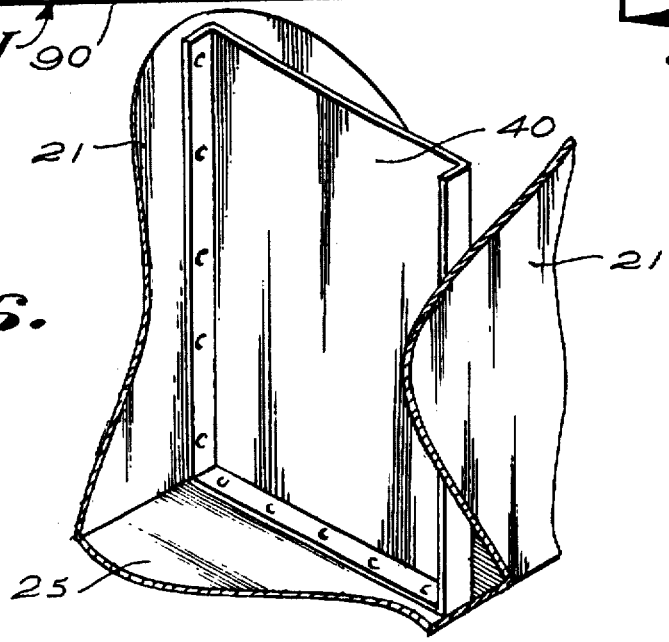
Fig: 6.

GLYCOL CHILLER MACHINE

This application is a continuation in part of my copending application for U.S. Letter patent Ser. No. 03/419,286, filed Apr. 10, 1995; and, entitled: HEAT EXCHANGER.

BACKGROUND OF THE INVENTION

In the art of making and dispensing beverages and the like it is common practice to chill the beverages to desired low temperatures prior to their being dispensed. To affect chilling beverages, preparatory to their being served, various heat exchanging means have been provided by the prior art.

The most effective and efficient heat exchanging means in use today consists of heat exchanger tanks through which prechilled liquid coolants are circulated and in and throughout which elongate liquid or beverage conducting coils extend. As beverages are dispensed (as from a related dispensing valve) they flow through the beverage conducting coils in the tanks and are chilled, as desired.

The prechilled liquid coolants circulated through the heat exchangers, as noted above, are water or are water with antifreeze agents added thereto and that are commonly referred to as "glycol".

The prechilled glycol coolants are chilled in machines commonly called "glycol chillers." Those glycol chillers provided by the prior art for use in beverage handling machines and equipment consist of elongate upwardly opening cylindrical glycol holding tanks; freon charged electric motor driven refrigeration machines including elongate helically wound refrigerant expansion coils that are arranged within the tanks and emersed in the glycol therein. Refrigerant is recirculated through the expansion coils to absorb heat from the glycol in the tanks and chills it, as desired.

The above noted prior art glycol chillers include chilled glycol delivery lines with upstream ends that are connected with the glycol tanks and that extend to and are connected with related beat exchangers or the like; and, glycol return lines with upstream ends connected with the heat exchangers and downstream ends that connect with the glycol tanks.

The above noted prior art glycol chillers next include electric motor driven pumps that are connected in one of the glycol conducting lines and that operate to continuously recirculate the glycol in and through the glycol tanks, heat exchangers and the glycol conducting lines.

The refrigeration machines of the above note prior art glycol chillers are turned on and off by means of temperature responsive power control switches that are responsive to the temperature of the glycol in some part or portion of the glycol tanks.

The glycol tanks of the prior art heat exchangers are commonly provided with loosely fitting removable lids that can be removed to monitor the level of glycol therein and to enable the introduction of replenishment glycol, as circumstances require.

Finally, the majority of prior art glycol chillers of the character referred to above are provided with motor driven propellers positioned in the glycol tanks to maintain the glycol therein circulating about the expansion coils.

Without the above noted propellers, glycol flowing through the tanks establish flow patterns that are such that the glycol circulating through the tanks is not evenly chilled and refrigerant in the expansion coils is not put to its most effective and efficient use. While the provision and use of motor drive propellers and the like, to maintain glycol in the tanks in circulating therein, enhances the efficiency of the chillers to chill glycol, they only work to set-up or establish and maintain different flow patterns in the glycol tanks and are therefore of questionable utility. In practice, where the noted propellers are provided, positioning and directing the propellers in the tanks is tinkered with or (moved about or adjusted) until it is appears that the chillers are operating about as effectively and efficiently as their design and construction might afford.

It has been found that in those prior art glycol chillers of the character noted above, the amount of heat that the freon refrigerants absorb from the glycol most often is less than one half the amount of heat that the refrigerants used are capable of absorbing and carrying away.

A major and often times serious problem encountered in the operation and use of those prior art glycol chillers described above resides in the fact that the glycol coolants evaporate at a notable rate and the glycol liquid level in the glycol tanks often drops to an extent that the chillers no longer function as intended.

Most often, it is not until the liquid level of glycol in the glycol tanks lowers to that extent where the evaporation coils are no longer within the glycol and/or air becomes entrained in the glycol and the chillers can no longer chill the glycol that the operators of the chillers are alerted to the fact that the supply of glycol in the tanks needs to be replenished. When the foregoing occurs, large volumes of tepid replenishment glycol are poured or dumped into the open tops of the glycol tanks and the chillers are let to operate for protracted period of time before the entrained air is let to escape and the new, replenished volumes of glycol in the chillers are chilled to desirable operating temperature.

To delay the time when the level of glycol in glycol tanks lowers excessively, those in the prior art have simply increased the vertical extent of the tanks so that the level of glycol therein is higher than need be and so that a notable volume of glycol can evaporate before creating adverse effects. This practice adversely increases the size and the weight of the glycol chillers and adversely effects the efficiencies thereof by requiring greater volumes of glycol to be chilled than is necessary.

In practice, when tepid replenishment glycol is dumped into the glycol tanks of the prior art glycol chillers, the chillers are subjected to what can be called "thermal shock" that warms the glycol in the tanks to an extent that the chillers fail to deliver suitably chilled glycol and cause the refrigeration machines to work under maximum load for substantial periods of time; before desired operation of the chillers is reestablished. Accordingly, the operators of chillers tend to delay or postpone replenishment of glycol in the glycol tanks until it becomes absolutely necessary to do so.

OBJECTS AND FEATURES OF THE INVENTION

It is an object of my invention to provide an improved glycol chiller in which the flow of glycol coolant longitudinally of and about a refrigerant expansion coil is controlled and managed to assure the effective and efficient exchange of heat between the glycol at the exterior of the refrigerant within the coil.

Another object of my invention is to provide an improved glycol chiller of the general character referred to above wherein the volume of glycol directly worked upon by the refrigerant expansion coil is a small fraction of the volume of glycol worked upon by the refrigerant expansion coils of prior art glycol chillers of comparable capacity and, an improved glycol chiller that is therefor substantially smaller and lighter than prior art glycol chillers of comparable capacity.

Yet another object of the present invention is to provide an improved glycol chiller of the general character referred to above that includes novel means for prechilling and continuously introducing replenishment glycol into the volume of glycol worked upon by the expansion coil, without the likelihood of air being introduced into that glycol and without thermal shock that might adversely affect functioning of the chiller.

Still another object of my invention is to provide an improved glycol chiller of the general character referred to above that includes an elongate vertically extending tank with a lower glycol chilling chamber and an upper replenishment glycol chamber or reservoir; and, a glycol chiller wherein the reservoir and chiller chamber are separated by a heat conducting metal wall with at least one glycol transfer port therein and through which chilled replenishment glycol in the resovour is free to flow into the chiller chamber to maintain the chiller chamber completely flooded and filled with glycol at all times.

Yet another object and a feature of the invention to provide and improved glycol chiller of the general character referred to above wherein the tank has a filler opening to the resovour and a liquid level signaling means related to the resovour and operating to emit a signal when the level of replenishment glycol in the resovour lowers to that point where additional replenishment glycol should be added to the replenishment glycol in the resovour to assure continued proper function of the glycol chiller.

It is an object and a feature of my invention to provide an improved glycol chiller of the general character referred to above wherein the lower glycol chiller chamber has a plurality of partitions defining an elongate zig zag flow passage with upstream and downstream ends or predetermined longitudinal extent and predetermined cross-section; and, an electric powered freon refrigerant charge refrigeration machine with an elongate freon refrigerant expansion coil that is positioned substantially centrally of and that extends longitudinally of the zig zag flow passage.

Further, it is an object and a feature of the invention to provide an improved glycol chiller of the character referred to above that includes glycol inlet and outlet fittings at the upstream and downstream ends of the zig zag flow passage to connect with glycol return and delivery lines that extend to a heat exchanging device served by through which glycol is conducted; and, a motor driven pump engaged between the glycol return line and inlet fitting that operates to cause glycol to recirculate through the tank, lines and device, as circumstances require.

It is an object and feature of this invention to provide and improve glycol chiller of the general character referred to above that includes an electric power supply for the refrigeration machine and a temperature actuated power on and off switching means in the power supply and responsive to the temperature of glycol in the upstream end of the zig zag flow passage.

Finally, it is an object and a feature of the invention to provide an improved glycol chiller of the general character referred to above that includes a thermal insulating jacket structure about the tank.

The foregoing and other objects and features of my invention will be apparent and will be fully understood from the following detailed description of one typical preferred embodiment of the invention throughout which description reference is made to the accompanying drawings.

DESCRIPTION OF THE DRAWINGS

FIG. 3 is a sectional view taken substantially as indicated by line 3—3 on FIG. 2;

DETAILED DESCRIPTION OF THE INVENTION

Figure 1:
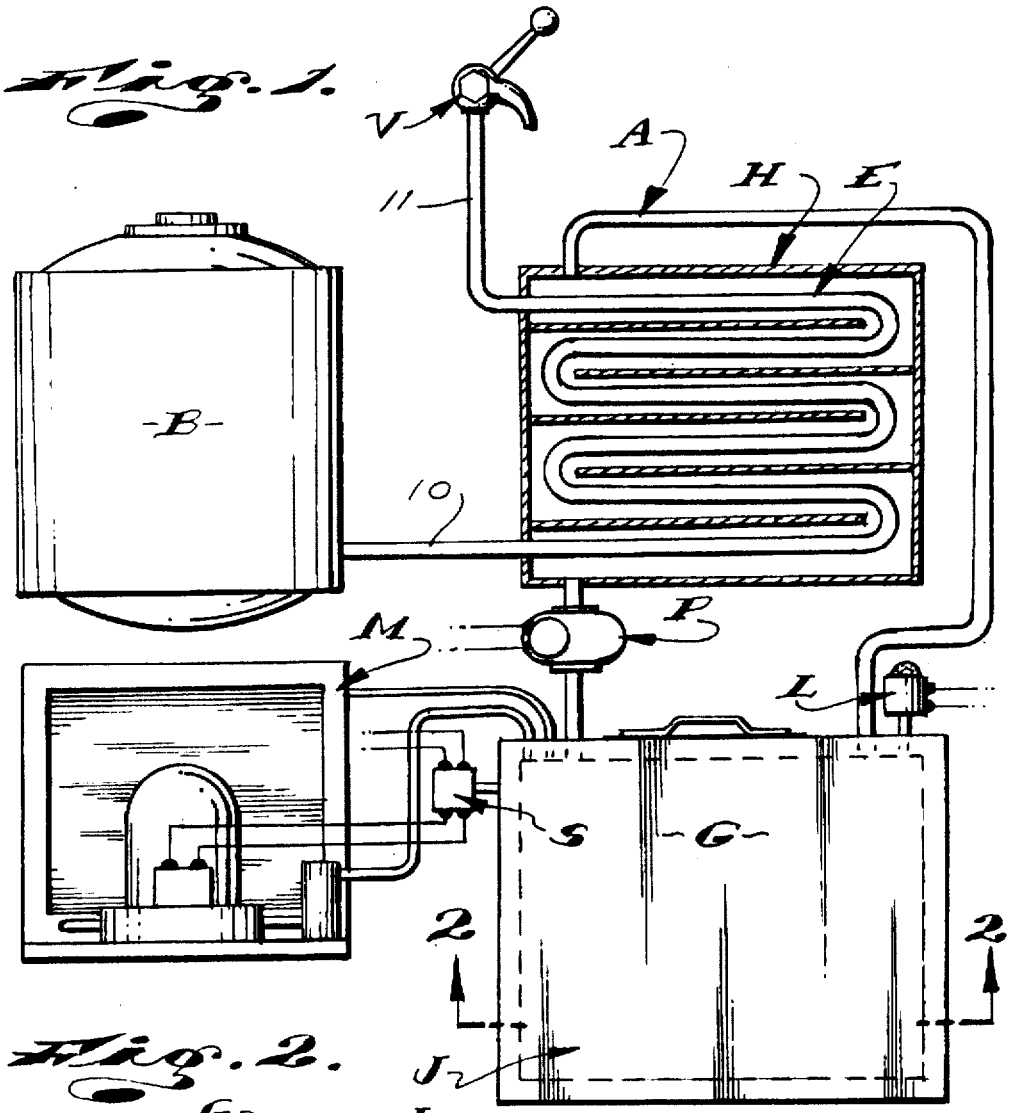
FIG. 1 is a diagrammatic view of a beverage dispensing apparatus including a glycol chiller embodying the present invention.
Figure 2:
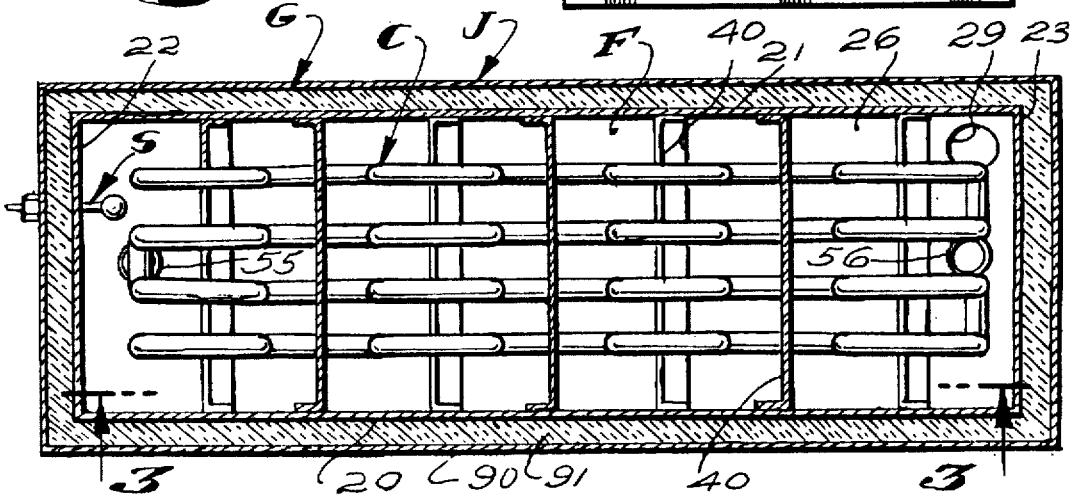
FIG. 2 is a sectional view of the glycol chiller taken substantially as indicated by line 2—2 on FIG. 1.
Figure 4:
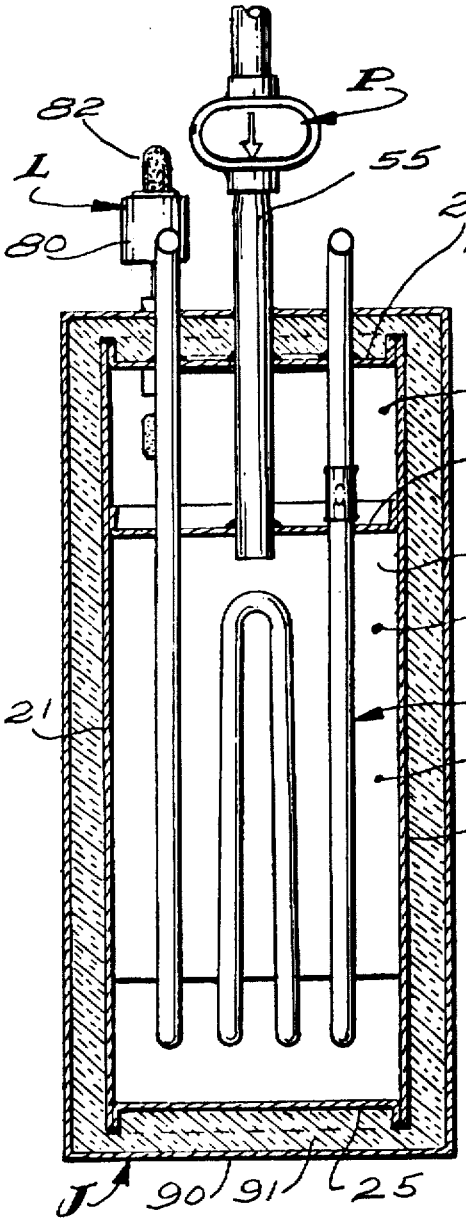
FIG. 4 is a sectional view taken substantially as indicated by line 4—4 on FIG. 3.
Figure 5:
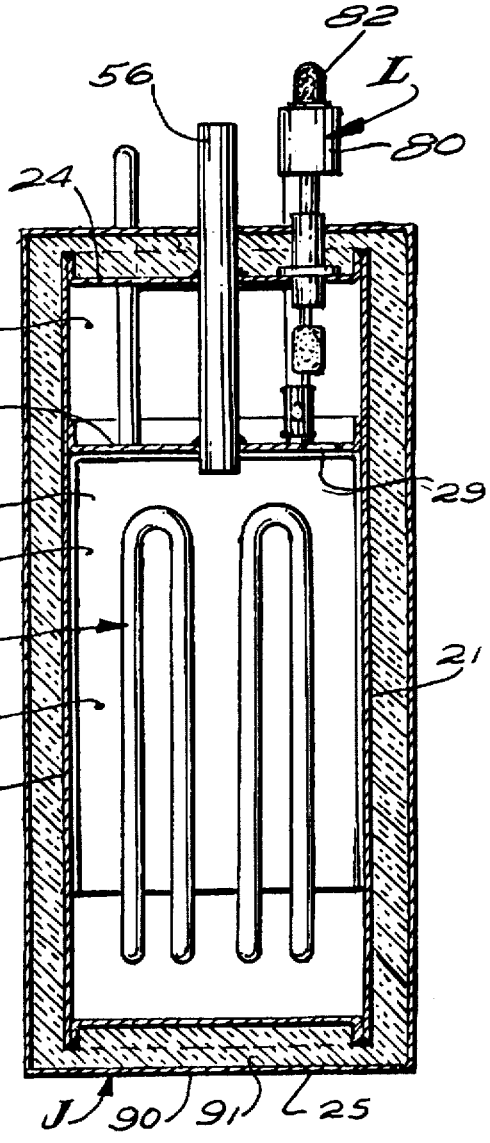
FIG. 5 is a sectional view taken substantially as indicated by line 5—5 on FIG. 3; and, FIG. 6 is an isometric view showing a detail of the construction.

In FIG. 1 of the drawings, I have illustrated a simple form of beverage dispensing apparatus A including a glycol chiller G embodying my invention.

The apparatus A first includes a beverage supply tank B. To affect a desired flow of beverage from within the tank B the tank can be elevated; pressurized; or can be provided with a beverage delivery pump means, as desired or as circumstances might require.

The apparatus A next includes a heat exchanger tank H through which chilled glycol is conducted and through which an elongate beverage conducting coil E extends. A beverage line 10 extends from the tank B to the upstream end of the coil E.

The apparatus next includes a beverage dispensing valve V that is connected with the downstream end of the coil E by a beverage flow line 11.

Finally, the apparatus A includes a glycol chiller G that embodies the present invention and that operates to chill glycol and cause the glycol to circulate substantially continuously through the heat exchanger H.

It will be apparent that the apparatus A illustrated and described above is such that when the valve V is opened to dispense beverage, beverage flows from the tank B through the heat exchanger H, where it is chilled preparatory to being advanced out through the open valve V.

In practice, the glycol chiller G of the present invention can be advantageously related to and/or incorporated in many other forms and/or kinds of liquid handling machines and apparatus.

The glycol chiller G includes an elongate vertically extending tank T within a thermal insulating jacket structure J.

The tank T has flat, spaced apart vertical, front and rear walls 20 and 21 with opposing inside surfaces; flat, laterally spaced, vertical side walls 22 and 23; vertically spaced, flat, horizontal top and bottom walls 24 and 25; and, a flat, horizontal intermediate central wall 26 that occurs in vertical spaced relationship between the top and bottom walls 24 and 25 with top and bottom surfaces opposing the bottom and top surfaces of the walls 24 and 25. The wall 26 divides the interior of the tank into upper and lower chambers. The upper chamber being a replenishment glycol holding reservoir R are and the lower chamber being a glycol recirculating or chilling chamber D.

The top wall 24 of the tank has a filler opening 27 that is normally closed by a removable lid 28. The central wall 26 has a transfer port 29, of limited size, that allows replenishment glycol stored in the reservoir R to flow or drain down into the chilling chamber D. The bottom wall 25 is imperforate.

The several horizontal walls 24, 25 and 26 are similar in plan configuration and are formed with a vertical flanges about their perimeters.

The vertical front, rear and side walls 20, 21, 22 and 24 are established of a single sheet of metal formed to extend about the horizontal walls when related thereto. When assembled, the walls 20, 21, 22 and 23 are spot welded to the perimeter flanges of the walls 24, 25 and 26.

The single sheet of material establishing the vertical walls 20, 21, 22 and 23 has two opposing vertical edges (not shown) that are welded together during manufacture of the tank.

The seams between the perimeter flanges of the top and bottom walls and their related vertical walls of the tank are suitably sealed, as by welding, during manufacture of the tank.

In addition to the foregoing, the tank is provided with a plurality of flat, laterally spaced, vertically extending partitions 40 within the lower chilling chamber D. The partitions 40 are arranged to define an elongate zig zag flow passage F that has upstream and downstream ends.

The partitions 40 are flat vertical plate-like parts that are on planes parallel with the planes of the sidewalls and that are normal to the planes of the front, rear, bottom and central walls 20, 21, 24, 25, and 26. The partitions are shorter in vertical extent than the vertical distance between the bottom wall 25 and the central wall 26 and are equal in width with the distance between the front and rear walls 20 & 21.

Each partition has vertically extending flanges at its side edges that establish flat engagement with the inside surfaces of the front and rear walls 20 & 21 and has a horizontal flange at one end that establishes flat bearing engagement with the top surface of the bottom wall or with the bottoms surface of the central wall as circumstances require.

The several partitions 40 are arranged so that the end flange of every other or second partition engages the top surface of the bottom wall and the end flange of each of the other or intermediate partitions engages the bottom surface of the central wall 26. The upper or free ends or of said every other or second partition is spaced vertically below the bottom surfaces of the central wall and the lower or free ends of the said intermediate partitions occur in vertical spaced relationship above the top surface of the bottom wall. The vertical distance or space between the free ends of the partitions and there opposing intermediate and bottom walls is substantially equal to the lateral distance between adjacent partitions. As a result, the zig zag flow passage defined in the tank by the partitions is substantially equal in cross-section throughout its length.

In practice it is not necessary that the partitions be sealed with the walls of the tank with which they are engaged. This is because the close fit of the flanges with their related wall restricts flow of glycol therebetween and the friction loss generated pressure differentials that might occur in the coolant at opposite surfaces of the partitions is insignificant and not such that an adverse cross-flow of coolant about the flanged edges and flanged ends of the panels is likely to be accure.

In accordance with the above, the several panels need only be securely fixed in working position with their related walls of the tank. To this end, in practice, one or more of the flanges of the partitions is spot welded to or with its related wall of the tank.

In the case illustrated, the upstream end portion of the flow passage F is at the left side of the tank and terminates at the bottom surface of the central wall 26 and the downstream end portion of the flow passage is at the right side of the tank and terminates at the bottoms surface of the central wall.

In practice, one or both of the ends of the flow passage can be made to terminate at the top surface of the bottom wall if desired or if circumstances require. Further, in practice, if desired or if circumstances require the partitions can be horizontally disposed and arranged in vertical spaced relationship within the tank with the ends of the flow passage defined thereby terminating at opposite sides of the tank; adjacent the bottom wall or adjacent the central wall, as desired.

The glycol chiller G next includes an elongate tubular freon refrigerant expansion coil C that is formed in substantial zig zag form and is positioned to extend centrally and longitudinally of the flow passage F, as clearly shown in the drawings.

The coil C has an upstream end portion 50 that extends vertically upwardly through the central wall 26, reservoir R and the top wall 24 of the tank. The upstream end portion of the coil is within the reservoir R and is provided with or carries a suitable expansion valve device. The downstream end portion of the coil extends from the top of the tank and extends to and connects with other related parts of the refrigeration machine M of which it is a part.

In the form of the invention illustrated the heat exchanging or working portion of the coil that occurs within the flow passage F is approximately four times longer than the flow passage F and is formed and positioned within the flow passage to make four passes longitudinally therethrough. In practice the heat exchanging portion of the coil C within the flow passage F can be approximately twice the length of the flow passage and can be formed to make two passes through the passage. Alternatively, the portion of the coil within the flow passage can be substantially equal in length with the flow passage three and formed to make but one pass through the flow passage; or, can be made five or more times longer than the flow passage and formed to make multiple passes through the flow passage, without departing from the broader aspects and spirit of my invention.

The length, form and arrangement of the coil C within the flow passage F is established to assure that the refrigerant flowing therethrough is most efficiently used to chill the glycol coolant flowing through the flow passage. Glycol chillers embodying my invention that are of different capacity; that have flow passages of different length and/or crossection; utilize different refrigeration machines; use different refrigerants and/or coolants and/or that work with different volumes of glycol flowing at different rates are likely to require different lengths and/or sizes of expansion coils. By adopting one of the above noted forms of expansion coils with made of suitable size of tube stock, a highly effective and effective and efficient chiller embodying the present invention can be made.

The tank structure T of my new glycol chiller G next includes glycol inlet and outlet fittings 55 and 56 to affect connecting the upstream end of the flow passage F with a glycol return line that extends from a related heat exchanger or the like that is served by the glycol chiller and to effect connecting the downstream end of the flow passage F with a glycol delivery line that extends from the glycol chiller G; as described in FIG. 1 of the drawings to the heat exchanger.

The fittings 55 and 56 can vary widely in form and construction and are shown as simple elongate vertically extending tubular parts with open upper and lower ends and that extend upwardly from within their related upstream and downstream ends of the flow passages through the central wall 26, reservoir R and top wall 24; and that terminate above the tank structure where they are accessible for connecting with related glycol conducting lines and/or parts.

The glycol chiller next includes an electric motor-driven pump P connected between the upper inlet end of the inlet fitting 55 and the glycol return line E. The pump P operates to establish a continuous flow and recirculation of glycol through the chiller G a related heat exchanger or the like with which the chiller G is related and serves.

The electric powered, freon charged refrigeration machine M of which the coil C is a part is an ordinary or common refrigeration machine of the kind that is familiar to all of those who are skilled in the art. Any one of the numerous commercially available refrigeration machines of suitable tonnage or capacity can be advantageously used in carrying out the present invention. The machine M is powered by electricity from a suitable power supply, in accordance with common practices.

Since the machine M is a common or ordinary, commercially available machine that is well known to all of those skilled in the art, further detailed description of the machine need not and will not be offered.

The glycol chiller G next includes a thermal responsive switch means S for turning the machine M on and off in response to the temperature of the glycol in the chiller chamber D or flow passage F therein. The switch means S is shown as including a box-like switching unit 60 with an elongate capillary tube and ball-type temperature part 60 & 61. The unit A is positioned above the tank with its capillary tube and bulb port depending therefrom through the top wall 24; reservoir R, central wall 26 and into the upstream end of the flow passage F. The switching unit U is suitably connected in a power supply line to the machine M. When the temperature of the recirculating glycol reentering the flow passage F drops below a determined and preset minimum operating temperature the means S operates to cause power to the machine M to be shut-off. When the temperature of the glycol reentering the flow passage is above the noted preset minimum temperature the means S operates to cause power to be delivered to the machine F.

It has been determined that when a switching means S, such as the unit U is made responsive to the temperature of the glycol reentering the flow passage and within the upstream end portion thereof, the machine M is cycled on and off less often than when the switching means is made to be responsive to the temperature of the glycol in the downstream end of the flow passage F or at any other location throughout the system of which the chiller G is a part. This is due to the fact that the temperature of the glycol reentering the flow passage is at its highest temperature. Accordingly, it is within the upstream end portion of the flow passage where the temperature of the glycol will last increase to that temperature at which the machine M is caused until the temperature of the glycol within that portion of the flow chamber is lowered to that temperature where the machine M is turned off.

It has been found that when a temperature responsive switching means for the machine M is, for example, responsive to the temperature of the glycol within the downstream end of the flow passage F it will not operate to turn the machine on until excessively warm glycol reentering the upstream end of the flow passage has advanced through the entire length of the flow passage to reach the switching means. This results in the entire volume of glycol in the chiller to warm excessively. When this occurs the machine M, for apparent reasons, will cycle on and off repeatedly, chilling rather small portions of the glycol flowing through the chiller until the temperature of the whole of the volume of glycol flowing through the entire system with which the chiller G is related is below the set maximum operating temperature.

In practice, the transfer port 29 in the intermediate wall 26 of the tank and through which replenishment glycol flows from the reservoir R into the flow passage F is positioned to open into the flow passage well downstream from the switching means 60 so that functioning of the switching means 60 is not adversely affected by the introduction of replenishment glycol into the glycol flowing through the flow passage. In this regard though, the replenishment glycol in the reservoir R is prechilled, a temperature differential of several degrees is likely to exist between the replenishment glycol in the reservoir and the glycol that is circulating through the flow passage.

The glycol chiller G next includes a liquid level signaling means related to the reservoir R that operates to emit a signal when the liquid level of the glycol in the reservoir is lowered to a level where additional replenishment glycol must be added to the supply of replenishment glycol to assure continuous, uninterrupted operation of the chiller G. the signaling means L includes a suitable liquid level sensing device or liquid level actuated switching device mounted on the tank and within the reservoir R as desired or as circumstances might require. The switching device, identified by the reference number 80 is connected in a power supply line to a signal emitting device such a lamp 81, that can be suitably positioned where it is most likely to be observed by the owner and/or operator of the chiller when it is energized.

Finally, the glycol chiller G includes a thermal insulating jacket structure J that is formed or built about the exterior of the tank structure. In the preferred carrying out of the invention, the preferred jacket structure J consists of an outside shell structure of sheet metal or the like that occurs in spaced relationship with the exterior surfaces of the tank and a core of non-interconnected cellular foam that is cast in the space between the shell structure and the tank structure, in accordance with old practices.

While the operation of the glycol chiller illustrated and described above is rather simple and apparent, it is to be particularly noted that the intermediate wall 26 that separates the reservoir R from the chiller chamber 24 and the flow passage F therein is a heat conducting metal part (as are the several walls of the tank) and is such that it works to transfer heat from replenishment glycol in the reservoir R into the glycol flowing through the flow passage F and thereby chills the replenishment glycol. Otherwise stated, the glycol flowing through the flow passage F absorbs heat from the intermediate wall 26 and the wall 26 absorbs heat from the replenishment glycol in the reservoir R, prechilling the replenishment glycol before it moves from the reservoir R into the flow passage. With this combination and relationship of parts the intended function of the glycol chiller G is not subject to be adversely affected by a loss of a full volume of glycol flowing through the flow passage F and is not subject to being adversely affected by thermal shock that would occur if substantial volumes of tepid replenishment glycol were to be periodically added to the glycol flowing through the flow chamber F (as taught by the prior art).

It is to be particularly noted that the flow of glycol in the flow passage F and about and longitudinally of the evaporator coil C is closely and tightly controlled and managed so that a full or substantially complete and uniform exchange of heat between the glycol in the flow passage and the refrigerant in the coil is substantially assured. There is no place within the chiller G where any currents and the like might be established in the glycol being worked upon by the coil C, might develop to adversely affect the efficient and effective operation of the chiller G.

Having described only one typical preferred form and embodiment of my invention I do not wish to be limited to the specific details herein set forth but wish to reserve to myself and modifications and/or variations that might appear to those skilled in the art and that fall within the scope of the following claims:

Having described my Invention I claim:

1. A glycol chiller comprising an elongate vertical sheet metal tank with spaced apart front and rear walls, laterally spaced vertical end walls, vertically spaced top and bottom walls and a horizontal central wall spaced vertically between the top and bottom walls and defining a lower glycol chiller chamber and an upper replenishment glycol reservoir within the tank, a filler opening in the top wall and a lid removably closing the filler opening, a flow transfer port in the central wall conducting replenishment glycol from the reservoir into the chiller chamber, a plurality of spaced apart partitions in the chiller chamber defining an elongate zig zag glycol flow passage with upstream and downstream ends within the chamber, glycol inlet and outlet fittings communicating with the upstream and downstream ends of the flow passage and projecting freely from the tank to connect with glycol return and glycol delivery lines extending from a heat exchanging device served by the glycol chiller; a motor driven pump positioned downstream from the inlet fitting and operating to continuously recirculate glycol downstream through the glycol chiller and the heat exchange device served thereby; an electric powered freon charged refrigeration machine including an elongate zig zag formed evaporator coil positioned within the chiller chamber and extending longitudinally through the flow passage; and, a thermal insulating jacket structure about the exterior of the tank.

2. The glycol chiller set forth in claim 1 that further includes a power supply to the refrigeration machine and a temperature responsive power on and power off switching device with a temperature sensing part in the flow passage and operating to turn the power on to the refrigeration machine when the temperature of glycol in the flow passage power off to the refrigeration machine when the temperature of glycol in the flow passage is below a set operating temperature.

3. The glycol chiller set forth in claim 2 wherein the temperature sensing part is in the upstream end of the flow passage.

4. The glycol chiller set forth in claim 1 that further includes a signaling means to a signal when the level of replenishment glycol in the reservoir drops to a predetermined level and that includes a normally open liquid level switching device in the reservoir and an electric powered signal emitting device connected with the switch.

5. The glycol chiller set forth in claim 1 that further includes a power supply to the refrigeration machine and a temperature responsive power on and power off switching device with a temperature sensing part in the flow passage and operating to turn the power off to the refrigeration machine when the temperature of glycol in the flow passage is below set operating temperature; a signaling means to emit a signal when the level of replenishment glycol in the reservoir drops to a predetermined level and that includes a normally open liquid level responsive switch in the reservoir and an electric powered signal emitting device connected with the switch.

6. The glycol chiller set forth in claim 2 wherein the temperature sensing part is in the upstream end of the flow passage; a signaling means to emit a signal when the level of the replenishment glycol in the reservoir drops to a predetermined level and that includes a normally open liquid level responsive switch in the resivour and an electric powered signal emitting device connected with the switch.

* * * * *